US007703696B2

(12) United States Patent
Eddins et al.

(10) Patent No.: US 7,703,696 B2
(45) Date of Patent: Apr. 27, 2010

(54) SPRINKLER TOY WITH GEYSER-LIKE BURST OF WATER

(75) Inventors: Fred D. Eddins, Mapleville, RI (US); Robert L. Brown, North Kingstown, RI (US)

(73) Assignee: Hasbro, Inc., Pawtucket, RI (US)

( * ) Notice: Subject to any disclaimer, the term of this patent is extended or adjusted under 35 U.S.C. 154(b) by 295 days.

(21) Appl. No.: 11/076,486

(22) Filed: Mar. 9, 2005

(65) Prior Publication Data

US 2005/0211805 A1 Sep. 29, 2005

Related U.S. Application Data

(60) Provisional application No. 60/555,597, filed on Mar. 23, 2004.

(51) Int. Cl.
*B05B 17/08* (2006.01)
*B05B 1/30* (2006.01)

(52) U.S. Cl. ..... 239/17; 239/576; 239/581.1; 239/12

(58) Field of Classification Search ..... 239/17, 239/19, 22, 23, 96, 99, 196, 101, 316, 323, 239/330, 337, 533.13, 569, 570, 576, 581.1, 239/581.2, 12; 137/624.14
See application file for complete search history.

(56) References Cited

U.S. PATENT DOCUMENTS 3,403,472 A * 10/1968 Raucourt ..... 49/31
4,204,462 A * 5/1980 Richards et al. ..... 493/158
4,205,785 A 6/1980 Stanley ..... 239/17
4,217,931 A * 8/1980 Jaekel ..... 137/606
4,265,404 A * 5/1981 Hunter ..... 239/747
4,301,967 A 11/1981 Hunter ..... 239/99
4,550,876 A 11/1985 Kulesza et al. ..... 239/211
4,781,217 A 11/1988 Rosenberg ..... 137/624.14
5,111,993 A 5/1992 Baker ..... 239/211
6,026,851 A 2/2000 Rosenberg ..... 137/508
6,082,633 A 7/2000 Kephart et al. ..... 239/211
6,250,565 B1 6/2001 Ogie et al. ..... 239/211
6,592,055 B1 7/2003 Marino ..... 239/275
6,691,739 B2 2/2004 Rosenberg ..... 137/614.2

* cited by examiner

*Primary Examiner*—Davis Hwu
(74) *Attorney, Agent, or Firm*—Marshall, Gerstein & Borun LLP

(57) ABSTRACT

The invention is directed to a sprinkler toy and a method for producing a geyser-like burst of liquid supplied by a source of pressurized liquid. The sprinkler toy may include a reservoir in fluid communication with the pressurized liquid source, wherein the volume of the reservoir may increase as the liquid is supplied to the reservoir by the pressurized liquid source. The sprinkler toy may further include a valve in fluid communication with the reservoir and operatively coupled to the reservoir, wherein the valve may be moveable between a closed position and an open position, wherein the increase of the volume of the reservoir from a first volume to a second volume may cause the valve to move from the closed position to the open position, and wherein the pressure within the reservoir when the valve moves to the open position may cause a geyser-like burst of liquid stored in the reservoir to discharge through the valve. In alternate embodiments, the sprinkler toy may further include nozzles in fluid communication with the pressurized water source and providing a constant discharge of liquid, and a housing having moving components that move in response to the increase in volume of the reservoir.

32 Claims, 13 Drawing Sheets

SPRINKLER TOY WITH GEYSER-LIKE BURST OF WATER

REFERENCE TO RELATED APPLICATION

This application claims priority from Provisional Patent Application Ser. No. 60/555,597, filed on Mar. 23, 2004, which is expressly incorporated by reference herein.

BACKGROUND OF THE DISCLOSURE

The present invention relates generally to a sprinkler toy and, more particularly, to a sprinkler toy discharging a constant mist of water and periodically discharging a larger geyser-like burst of water.

Various sprinkler systems adapted for the amusement of children have been previously described. For example, U.S. Pat. No. 4,550,876 to Kulesza et al. discloses a sprinkler toy in the shape of a fire hydrant and including a connector for placing the toy in fluid communication with a garden hose. A first spring nozzle is capable of communicating with the connector through a pivotally operated valve. The first nozzle includes a plurality of apertures for producing an upwardly directed, diffused liquid spray. A second nozzle, also capable of fluid communication with the connector through a pivotally operated valve, is connected to the remainder of the toy by a flexible hose. U.S. Pat. No. 6,082,633 to Kephart et al. discloses a toy sprinkler comprising a hub assembly having a water pressure activated spinning cap member and a manifold member connected to a pressurized water source. Multiple right angle arm assemblies are connected to the manifold and directed by a conduit to wand members mounted to remote ends of arm assemblies. The conduit affords sufficient slack to allow removal of the wand members from the arm assemblies and the aiming of water ejected from the wand members.

As a further example, U.S. Pat. No. 6,250,565 to Ogie et al. discloses a toy sprinkler with the appearance of an amusing figure or creature with appendages that simulate movement of the appendages of the figure or creature. Liquid-carrying conduits extending along appendages of the figure cause the appendages to move either in a planer path when liquid at low pressure passes through the conduits, or randomly when liquid at high pressure passes through the conduits. Still further, U.S. Pat. No. 6,592,055 Mariono discloses a free standing sprinkler device having an inflatable hoop-shaped manifold for children to utilize as a recreational fun toy. The inflatable manifold is mechanically removably connected by fluid transmitting coupling components to a base manifold and accordingly expands to a hoop-shaped component, responsive to the fluid pressure within, a sufficient size so as to permit persons to step or jump through the hoop-shaped component which appropriately sprinkles water therefrom on such persons.

SUMMARY OF THE INVENTION

In one aspect, the invention is directed to a sprinkler toy for producing a geyser-like burst of liquid supplied by a source of pressurized liquid. The sprinkler toy may include a reservoir in fluid communication with the pressurized liquid source, wherein the volume of the reservoir may increase as the liquid is supplied to the reservoir by the pressurized liquid source. The sprinkler toy may further include a valve in fluid communication with the reservoir with an exterior of the valve being operatively coupled to an exterior of the reservoir, wherein the valve may be moveable between a closed position and an open position, wherein the increase of the volume of the reservoir from a first volume to a second volume may cause the exterior coupling between the reservoir and the valve to move the valve from the closed position to the open position, and wherein the pressure within the reservoir when the valve moves to the open position may cause a geyser-like burst of liquid stored in the reservoir to discharge through the valve.

In another aspect, the invention is directed to a sprinkler toy for producing a geyser-like burst of liquid supplied by a source of pressurized liquid. The sprinkler toy may include an elastomeric bladder in fluid communication with the pressurized liquid source, wherein the volume of the bladder may increase as the liquid is supplied to the bladder by the pressurized liquid source. The sprinkler toy may also include a valve in fluid communication with the bladder, wherein the valve may be moveable between a closed position and an open position, and an actuation mechanism operatively coupling the bladder to the valve. The bladder may engage the actuation mechanism as the bladder expands from a first volume to a second volume, the actuation mechanism may move the valve from the closed position to the open position in response to the engagement by the bladder, and the pressure within the bladder when the valve moves to the open position may cause a geyser-like burst of liquid stored in the bladder to discharge through the valve.

In yet another aspect, the invention is directed to a method for producing a geyser-like burst of liquid from a sprinkler toy. The method may include operatively coupling a valve of the sprinkler toy to a reservoir of the sprinkler toy such that the valve and the reservoir are in fluid communication with each other, wherein an exterior of the reservoir is operatively coupled to an exterior of the valve, and wherein the valve may be moveable between a closed position and an open position. The method may also include connecting a pressurized liquid source to the reservoir such that the source and reservoir are in fluid communication, wherein the volume of the reservoir may increase as the liquid is supplied to the reservoir by the pressurized liquid source. Still further, the method may include providing pressurized liquid to the reservoir of the sprinkler toy to increase the volume of the reservoir from a first volume to a second volume to cause the exterior coupling between the reservoir and the valve to move the valve from the closed position to the open position, with the pressure within the reservoir when the valve moves to the open position causing a geyser-like burst of liquid stored in the reservoir to discharge through the valve.

DETAILED DESCRIPTION OF VARIOUS EMBODIMENTS

Although the following text sets forth a detailed description of an exemplary embodiment of the invention, it should be understood, that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
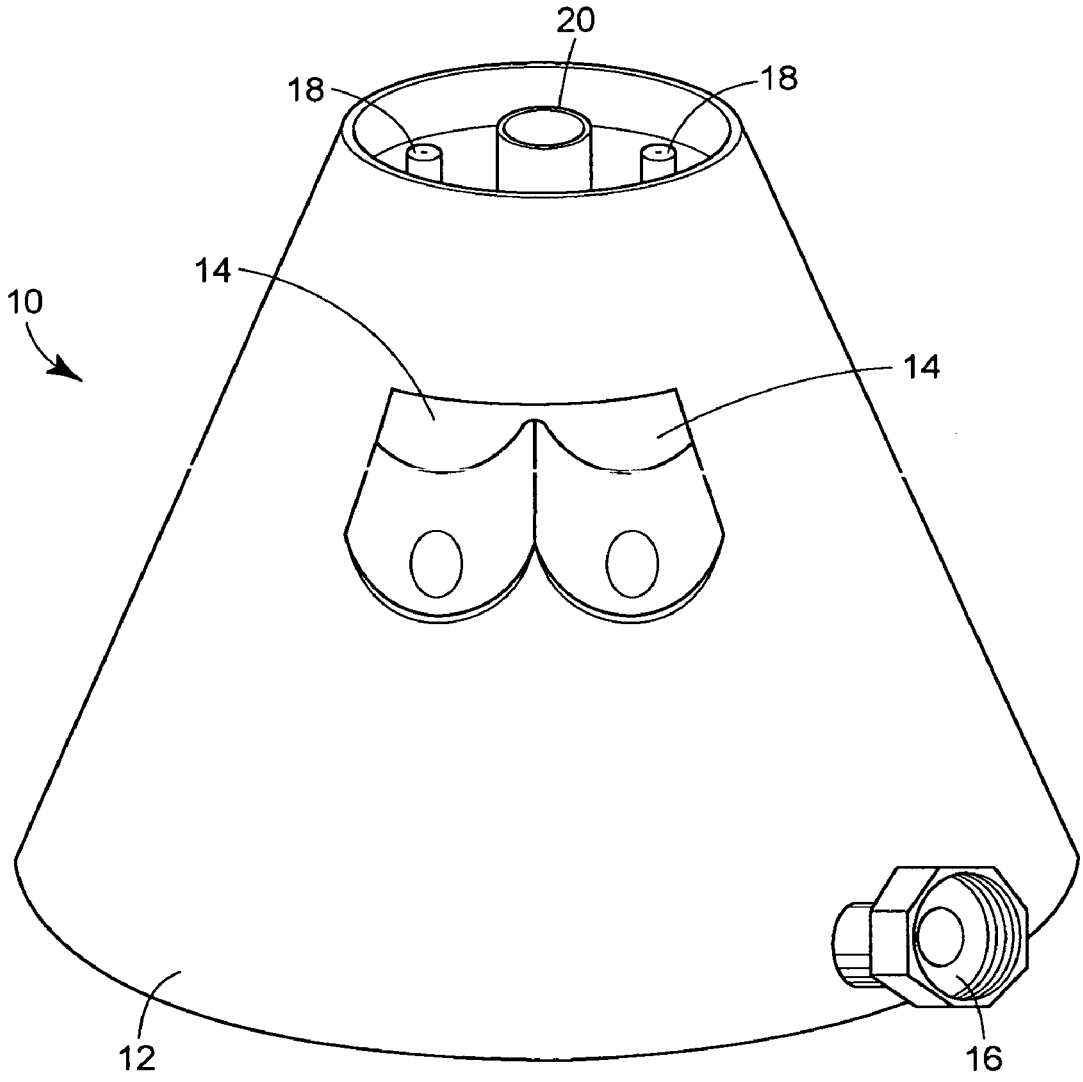
FIG. 1 is a top front perspective view of an embodiment of a sprinkler toy with a geyser-like burst of water.

FIG. 1 illustrates one embodiment of a sprinkler toy 10 in accordance with the present invention. The sprinkler toy 10 may include an outer hollow frustoconical housing 12 and an interior mechanism (not shown) configured to discharge pressurized water provided by a pressurized water supply. The outer housing 12 may further include moving components 14, such as eyeballs or eyelids, that may be configured to occupy a normal position such as to simulate eyes and eyelids being opened, and to be engaged by a portion of the interior mechanism to move to a second position, such as with the eyes closed, as the interior mechanism cycles between states where a geyser-like burst of water is not discharged, and where the geyser-like burst of water is discharged.

In order to supply pressurized water to the interior mechanism, a hose coupling 16 may extend outwardly from the outer housing 12 and be adapted to couple the interior mechanism of the sprinkler toy 10 to a source of pressurized water such as a garden hose. The hose coupling 16 may, via the inner mechanism of the sprinkler toy 10, be placed in fluid communication with one or more misting nozzles 18, and a larger nozzle 20. In a manner described more fully below, the interior mechanism of the sprinkler toy 10 may be configured such that, when pressurized water is pumped into the interior mechanism through the hose coupling 16, a constant mist is discharged from the nozzles 18, and a geyser-like burst of water may be periodically discharged from the large nozzle 20.

Figure 2:
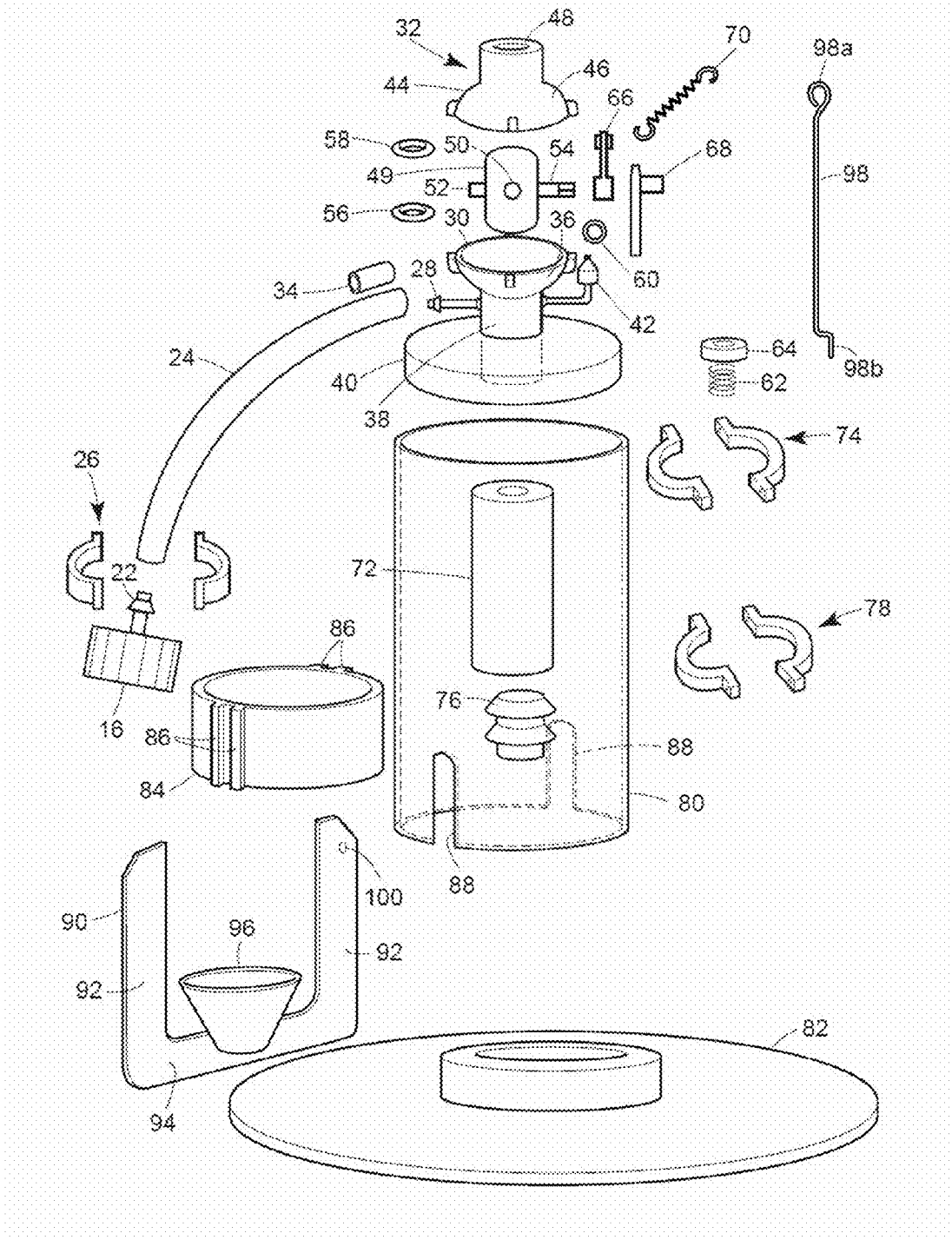
FIG. 2 is an exploded view of the components of an embodiment of a sprinkler toy with a geyser-like burst of water.

Referring to FIG. 2, an exploded view of an embodiment of the interior mechanism for the sprinkler toy 10 is illustrated. The hose coupling 16 may include an outlet stem 22 that may be inserted into one end of a supply tube 24, with the coupling 16 being secured to the supply tube 24 by a coupling clamp 26 attached to the supply tube 24 proximate the hose coupling 16 and surrounding the outlet stem 22. The opposite end of the supply tube 24 may be connected to an inlet stem 28 of a lower valve housing 30 of a ball valve 32, and held in place by a ferrule 34 disposed on the outside of the supply tube 24 and around the inlet stem 28.

The lower valve housing 30 may further include a first hollow semi-circular portion 36 having a bladder stem 38 extending downwardly from the bottom of the semi-circular portion 36 and through an opening in an enclosure cap 40. The bladder stem 38 may further include the inlet stem 28 and one or more misting nozzles 42 extending outwardly therefrom, with the lower valve housing 30 being configured such that the inlet stem 28, semi-circular portion 36, bladder stem 38 and nozzles 42 are in fluid communication such that liquid flowing into the inlet stem 28 may pass through each of the other components of the lower valve housing 30.

The ball valve 32 may further include an upper valve housing 44 having a second hollow semi-circular portion 46 corresponding to the hollow semi-circular portion 36 of the lower valve housing 30, and an upper large nozzle 48 in fluid communication therewith. The first and second hollow semi-circular portions 36, 46 may combine to define a cavity in which a ball 49 of the ball valve 32 may be disposed. The ball 49 may include a throughbore 50 defining a passage through the ball 49 through which liquid may flow from the lower valve housing 30 to the upper valve housing 44 and out the large nozzle 48 when the throughbore 50 is aligned with the bladder stem 38 and the large nozzle 48. The ball 49 may further include outwardly extending shafts 52, 54 that may be engaged by the walls of the semi-circular portions 36, 46 such that the ball 49 may be rotatable within the cavity formed by the semi-circular portions 36, 46 between a closed position wherein the throughbore 50 is out of alignment with the bladder stem 38 and large nozzle 48, and an open position wherein the throughbore 50 is aligned with the bladder stem 38 and large nozzle 48. Ball face O-rings 56, 58 may be disposed within the cavity defined by the semi-circular portions 36, 46 and be configured to engage the ball 49 and corresponding portions of the semi-circular portions 36, 46 to seal the cavity and prevent water from leaking through the ball valve 32 when the throughbore 50 is in the closed position.

In order to rotate the ball 49 between the closed position and the open position, the shaft 54 may extend outwardly through the semi-circular portions 36, 46 and be engaged by an actuation mechanism. To prevent leakage of water from the ball valve 32, the shaft 54 may have an O-ring 60 disposed thereon to form a seal between the shaft 54 and the inner surfaces of the semi-circular portions 36, 46. The ball valve 32 may further include a spring 62 and retainer clip 64 disposed on the shaft 54 between the ball 49 and the ball shaft O-ring 60 to bias the O-ring 60 into engagement with the inner surface of the semi-circular portions 36, 46. The portion of the shaft 52 extending outwardly from the ball valve 32 may be engaged by an actuation mechanism including a lever 66, a pivot plate 68 and a spring 70. Examples of ball valves and actuation mechanisms will be described more fully below.

The internal mechanism of the sprinkler toy 10 further includes an elastomeric bladder 72 having one end attached to the exterior of the bladder stem 38 of the ball valve 32 below the enclosure cap 40, and secured by an upper bladder clamp 74. At the opposite end of the bladder 72, a plug 76 may be inserted into the open end of the bladder 72 to form a substantially water-tight seal, and secured by lower bladder clamp 78. The bladder 72 and plug 76 may be enclosed by a support cylinder 80 having a top end attached to the enclosure cap 40 and a bottom end secured to a base 82 of the sprinkler toy 10. Support cylinder 80 may further include a stabilizer ring 84 disposed around, and attached to, the outer surface of the support cylinder 80. The stabilizer ring 84 may include pairs of outwardly extending shoulders 86 disposed on opposite sides of the stabilizer ring 84, with each pair of shoulders 86 defining a substantially vertical channel when the stabilizer ring 84 is disposed on the exterior of the support cylinder 80. Proximate the bottom edge of the cylinder 80, a pair of oppositely disposed slots 88 may be defined in the surface of the support cylinder 80 and extend upwardly from the bottom edge of the support cylinder 80.

The interior mechanism of the sprinkler toy 10 may further include a substantially U-shaped funnel bracket 90 having upwardly extending arms 92 connected by a substantially horizontal base 94. A funnel 96 may be connected to the base 94 of the funnel bracket 90 such that the open end of the funnel 96 extends upwardly.

The lower portion of the interior mechanism of the sprinkler toy 10 may be assembled as follows. Once the bladder 72 and plug 76 are attached to the bladder stem 38 below the enclosure cap 40, the upper edge of the support cylinder 80 may be connected to the bottom surface of the enclosure cap 40. The stabilizer ring 84 may be disposed on to the exterior of the support cylinder 80 and affixed thereto with epoxy or other attachment mechanism, with the channels formed by the shoulders 86 being substantially vertically aligned with the corresponding slots 88 of the support cylinder 80. Once the stabilizer ring 84 is attached, the funnel bracket 90 may be disposed on the cylinder 80 with the arms 92 disposed on the exterior of the support cylinder 80, and with portions of the inner surfaces of the arms 92 disposed within the channels defined by the shoulders 86 of the stabilizer ring 84. At the same time, opposite ends of the base 84 may be disposed within corresponding slots 88 of the support cylinder 80 such that the funnel 96 is disposed within the interior of the support cylinder 80 beneath the bladder 72 and plug 76.

With the base 94 of the funnel bracket 90 disposed within the slots 88, the bottom edge of the support cylinder 80 may be attached to the base 82. The slots 88 may be dimensioned such that the base 94 is slidable vertically within the slots 88, and correspondingly with the arms 92 slidable within the channels formed by the shoulders 86 of the stabilizer ring 84, when the lower edge of the support cylinder 80 is attached to the base 82. Once the ball valve 32 and the lower portion of the interior mechanism are assembled, the funnel bracket 90 may be operatively connected to the actuation mechanism by a link connected at one end 98*a* to the pivot plate 68, and at the opposite end 98*b* via a hole 100 through one of the arms 92 of the funnel bracket 90. As will be described more fully below, the spring 70 acting on the lever 66 and pivot plate 68 may bias the ball valve 32 to the closed position with the link 98 lifting the funnel bracket 90 vertically within the slots 88 to its normal position.

Once the interior mechanism of the sprinkler toy 10 is assembled, the interior mechanism may operate to discharge a constant mist through the nozzles 42, and a periodic large volume geyser-like burst through the large nozzle 48. When a pressurized water source is coupled to the hose coupling 16, water flows into the sprinkler toy 10 through the supply tube 24 to the lower valve hosing 30 of the ball valve 32. Initially, the ball valve 32 is in the closed position and prevents water from flowing into and through the ball valve 32. A portion of the water entering the lower valve housing 32 may be discharged from the nozzles 42 in the form of a mist. If the flow rate of the pressurized water entering the lower valve housing 30 exceeds the flow rate of the mist being discharged for the nozzles 42, the pressurized water may flow through the bladder stem 38 and into the bladder 72. As the water continues to flow into the sprinkler toy 10, the bladder 72 may expand elastically and thereby accumulate the pressurized water therein.

As the water accumulates, the bladder 72 and plug 76 extend downwardly within the support cylinder 80 and into the funnel 96. As the bladder 72 continues to expand, the funnel 96 and funnel bracket 90 are pushed downwardly towards the base 82, with the link 98 moving downwardly and causing the pivot plate 68 to rotate downwardly. As the funnel bracket 90 and funnel 96 continue to move downwardly, at a predetermined point when the direction of the force of the spring 70 acting on the lever 66 passes the axis of the shaft 54 and changes the direction the force of the spring 70 tends to rotate the ball 49, thereby causing the ball 49 to rotate to the open position with the throughbore 50 aligning with the bladder stem 38 and large nozzle 48. Once the throughbore 50 is aligned with the bladder stem 38 and large nozzle 48, the force of the walls of the bladder 72 acting on the water disposed therein thrusts the water upwardly through the channel formed by the bladder stem 38, throughbore 50 and large nozzle 48 to eject the water from the nozzle 48 in a geyser-like burst. As the water is discharged through the nozzle 48, the bladder 72 returns to its normal, unexpanded position, with the lower end of the bladder 72 and the plug 76 moving upwardly away from the base 82 of the sprinkler toy 10.

As the bladder 72 and plug 76 move upwardly, the funnel bracket 90 and funnel 96 are free to move upwardly, thereby allowing the ball 49 of the ball valve 32 to rotate back to its normal closed position with the actuation mechanism being reset to the normal position. In one embodiment, the lever 66, pivot plate 68 and spring 70 may be configured such that the force of the spring 70 when the ball 49 is in the open position tends to rotate the pivot plate 68 back toward its normal position. Without the downward force of the expanded bladder, the pivot plate 68 rotates toward its normal position with the link 98 lifting the funnel bracket 90 upwardly. As the pivot plate 68 rotates upwardly, the force of the spring acting on the lever 66 eventually passes the axis of the shaft 54 and changes the direction the force of the spring tends to rotate the ball 49, thereby causing the ball 49 snap back and rotate to the normal closed position. In order to ensure that the ball 49 and the funnel bracket 90 are properly reset to their normal positions after the water is discharged, additional springs or other elastomeric components may be included to bias the ball 49, funnel bracket 92, pivot plate 68 or other components of the actuation mechanism toward the normal position.

Figure 3:
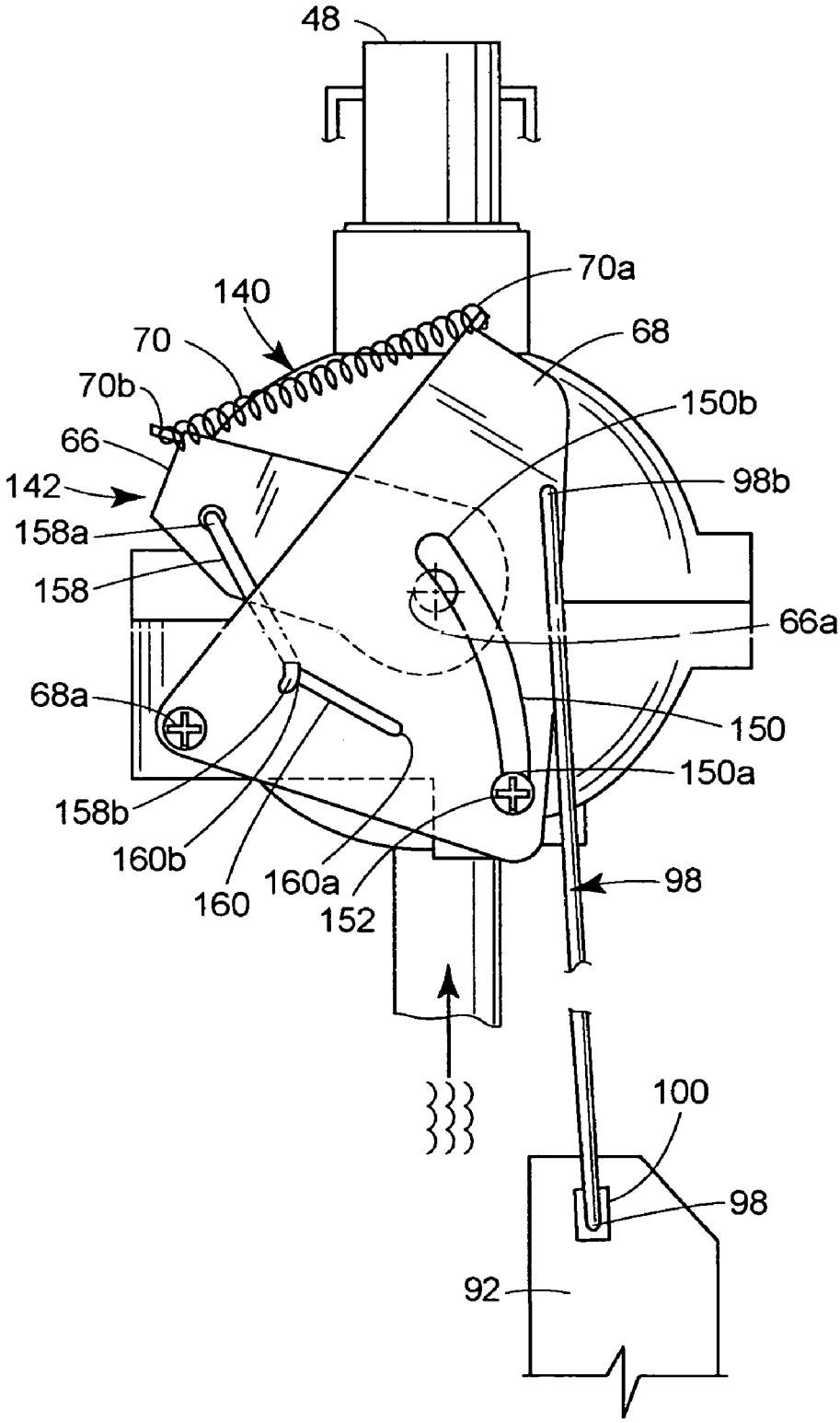
FIG. 3 is an enlarged fragmentary plan view of a trip valve mechanism illustrated in a first position.
Figure 4:
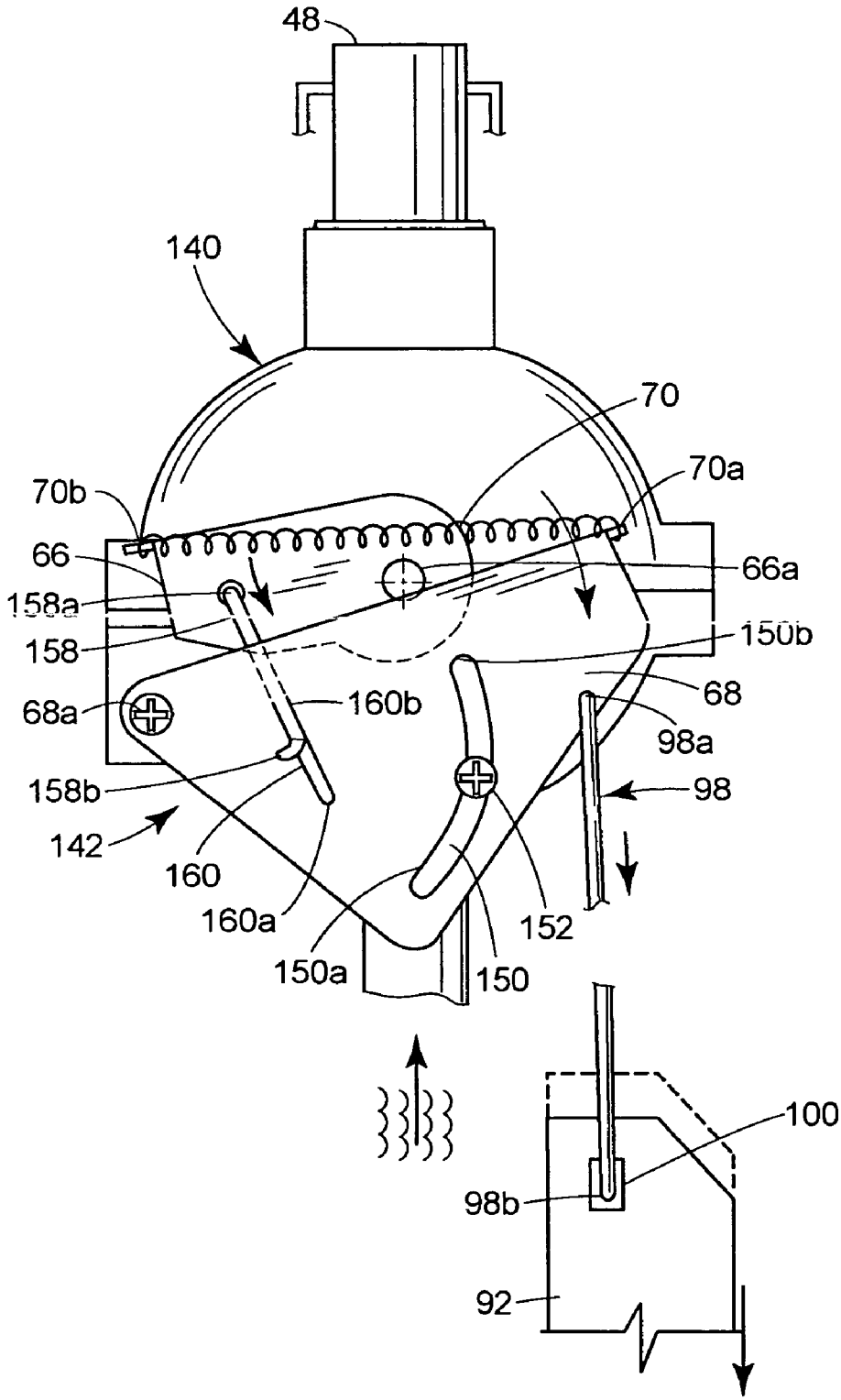
FIG. 4 is an enlarged fragmentary plan view similar to FIG. 3 and illustrating the trip valve in a second position.
Figure 5:
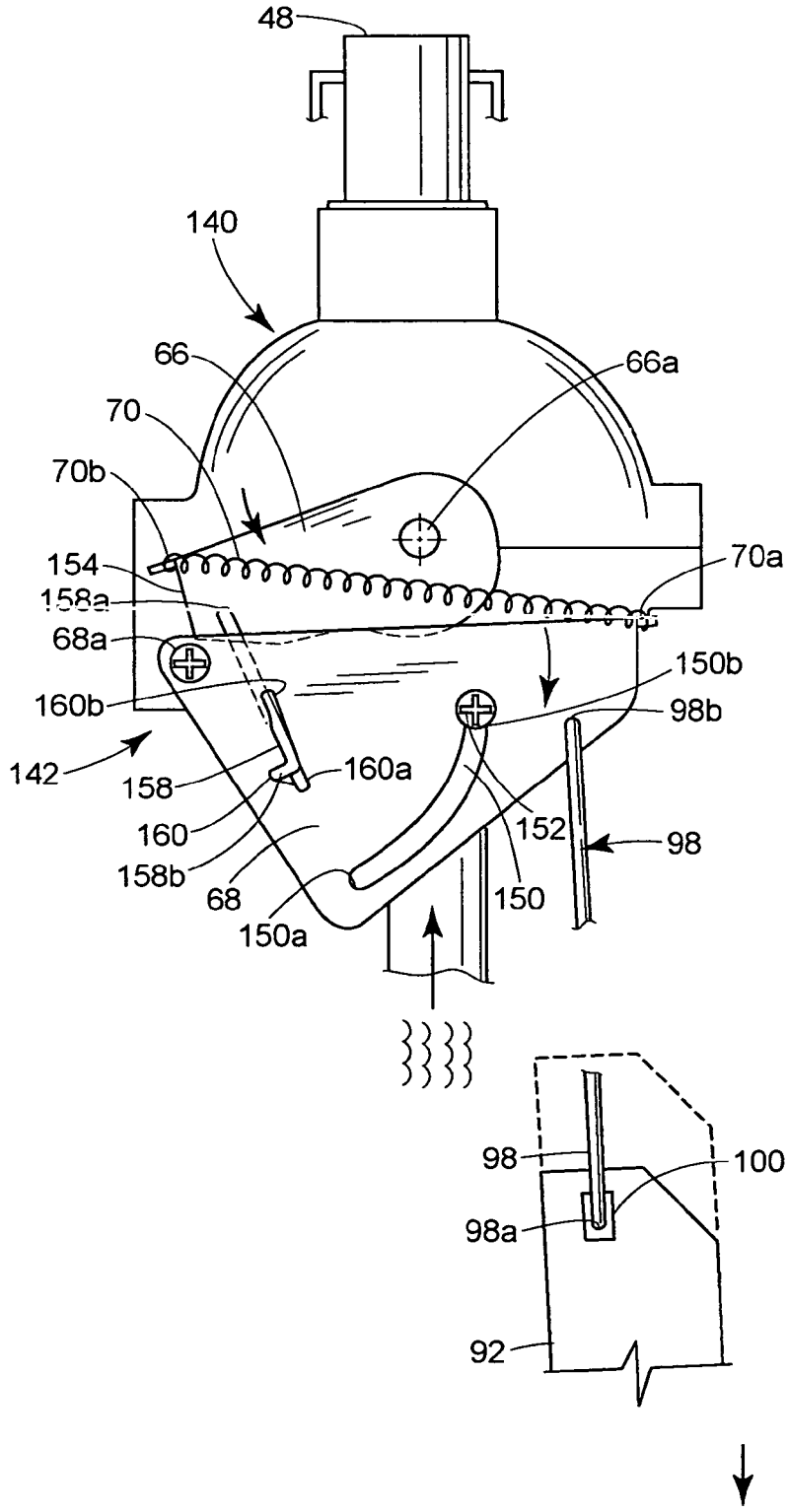
FIG. 5 is an enlarged fragmentary plan view similar to FIGS. 3 and 4 and illustrating the trip valve in a third position.

FIGS. 3-5 illustrate one embodiment of the ball valve assembly 32 and actuation mechanism 140 that may be used in the sprinkler toy 10 and that may include a trip assembly 142 which is operatively connected to an arm 92 via the link 98 connected at hole 100. The trip assembly 142 controls the actuation of the ball valve assembly 140 and enables the water to be discharged in a geyser-like burst. The trip assembly 142 includes the pivot plate 68 which pivots about a pivot point 68*a*. The upper end 98*b* of the link 98 is attached to the pivot plate 68. The pivot plate 68 includes a slot 150 having a pair of ends 150*a* and 150*b*, and a stop screw 152 is mounted so as to extend through the slot 150 and remain stationary relative to the ball valve housing. The lever 66 is operatively connected to the ball 49 disposed within the valve assembly 32, and the lever 66 is pivotable about a pivot point 66*a*. The lever 66 may be connected to the plate 68 by a link arm 158 which fits within a slot 160 in the pivot plate 68. The slot 160 includes a pair of ends 160*a* and 160*b*. The spring 70 is connected to the pivot plate 68 at 70*a* and to the lever 66 at 70*b*. When the plate 68 and the lever 66 are positioned as shown in FIG. 3, the ball 49 is closed, such that no water will be ejected from the upper large nozzle 48.

Referring now to FIG. 4, when the arm 92 moves downwardly when viewing FIG. 4 from an initial position shown in FIG. 3 to an intermediate position of FIG. 4, the linkage 98 pulls on the pivot plate 68, causing the pivot plate 68 to shift in a generally clockwise direction about the pivot 68*a*. In the process, the end 158*b* of the link arm 158 pulls the lever 154, causing the lever 66 to rotate in a generally counterclockwise direction about the pivot point 66*a*, thus opening the valve 32 such that water may be ejected from the large nozzle 48.

Referring now to FIG. 5, when the arm 92 is displaced sufficiently downward to a position as shown in FIG. 5, the pivot plate 68 may pivot sufficiently far that the stop screw 152 comes into contact with the end 150*b* of the slot 150. Eventually, the spring 70 will pass the pivot 66*a*, which causes the spring 70 to apply a further biasing force to the lever 66, thereby causing the lever 66 to rotate more rapidly in the counter-clockwise direction about the pivot point 66*a*. The link arm 158 may come into contact with the end 160*a* of the slot 160, thus limiting the rotational movement of the lever 66. The valve 32 may be arranged such that the valve is turned fully on when the lever 66 is rotated far enough.

Releasing the arm 92 due to the discharge of water from the bladder 72 will permit the trip assembly 142 to return to the position of FIG. 3. Without the weight of the water and downward pressure from the bladder 72, the force of the spring 70 may rotate the pivot plate 68 in the counterclockwise direction in FIG. 5, and correspondingly lift the funnel bracket 92 and funnel 96. Once the direction of the force of the spring 70 moves past the pivot point 66*a* of the lever 66, the lever 66 rotates rapidly in the clockwise direction to snap the valve 32 shut. Once the valve 32 is shut and the actuation mechanism 140 is in the normal position, pressurized water may again accumulate in the bladder 72 in preparation for discharging a subsequent geyser-like burst of water. Those skilled in the art will understand that this arrangement may operate to produce periodic bursts of water as long as the pressurized water is communicated to the sprinkler toy 10.

Consequently, in accordance with the disclosed example, the trip assembly 142 serves to define a first normal position shown in FIG. 3 (in which the valve 32 is closed), and a second open position shown in FIG. 5 (in which the valve 32 is in a fully open position), and to cause the valve 32 to move through intermediate positions (FIG. 4) therebetween. Other configurations may be chosen, including by way of example rather than limitation, a closed position and one or more open positions for the valve 32. Additional description of the actuation mechanism 140 and/or the trip assembly 142 can be found in U.S. Pat. No. 6,631,830, entitled "Snap Action Ball Valve Assembly and Liquid Dispenser Using the Same," the entire disclosure of which is incorporated herein by reference.

Figure 6:
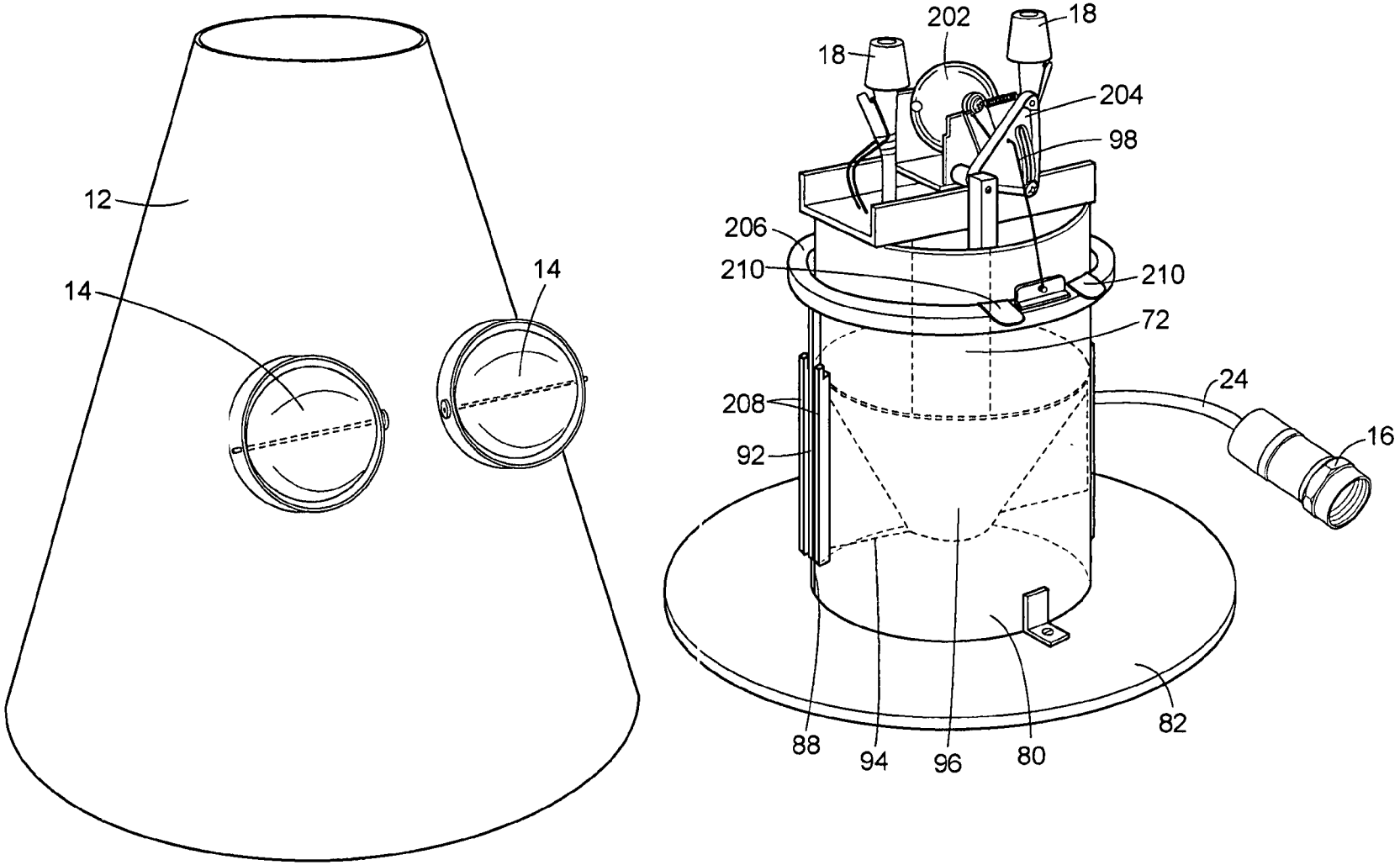
FIG. 6 is a perspective view of an embodiment of a sprinkler toy with a geyser-like burst of water with the hollow frustoconical outer housing removed from the inner mechanism.
Figure 7:
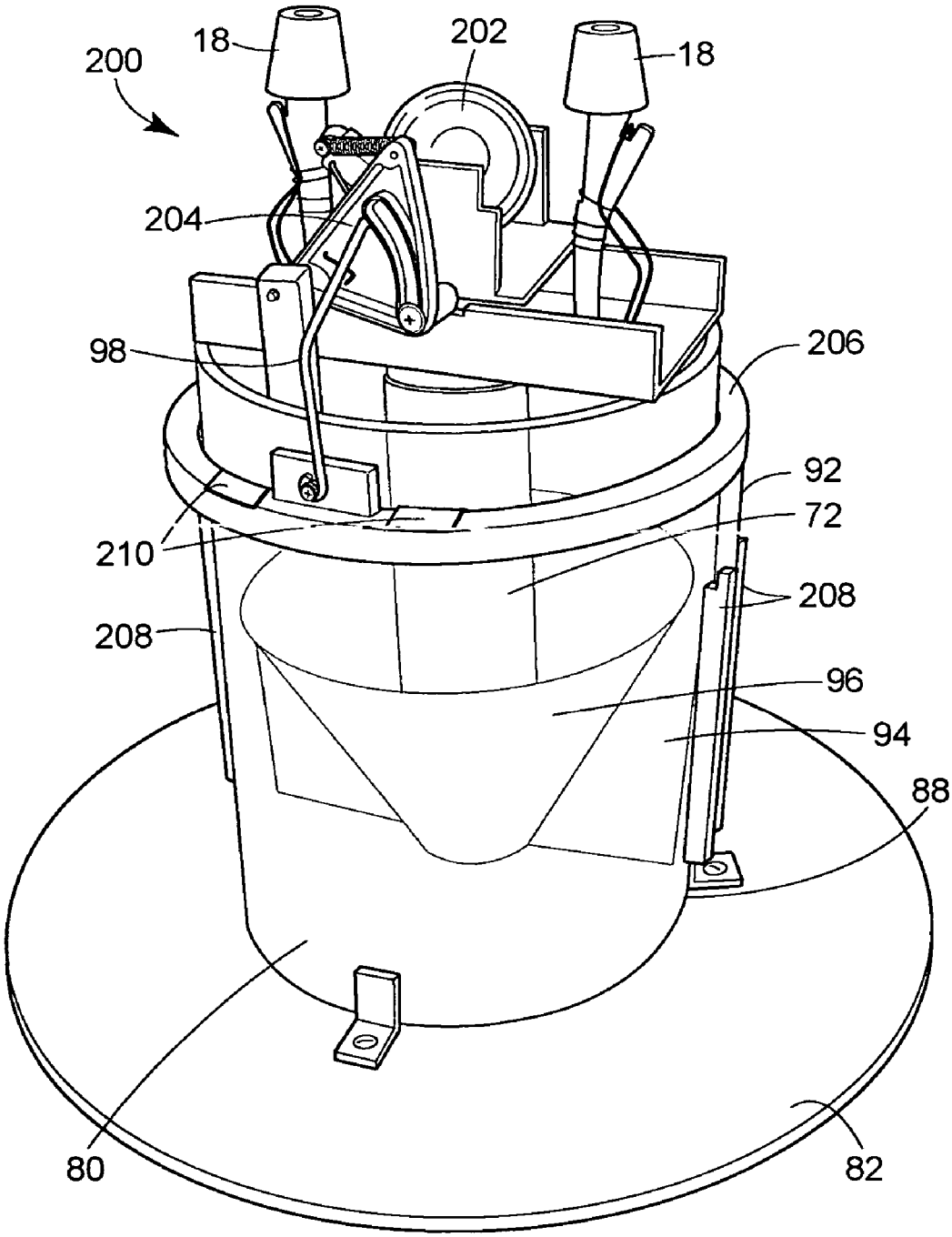
FIG. 7 is a perspective view of the inner mechanism of the sprinkler toy of FIG. 6 in a first position.
Figure 8:
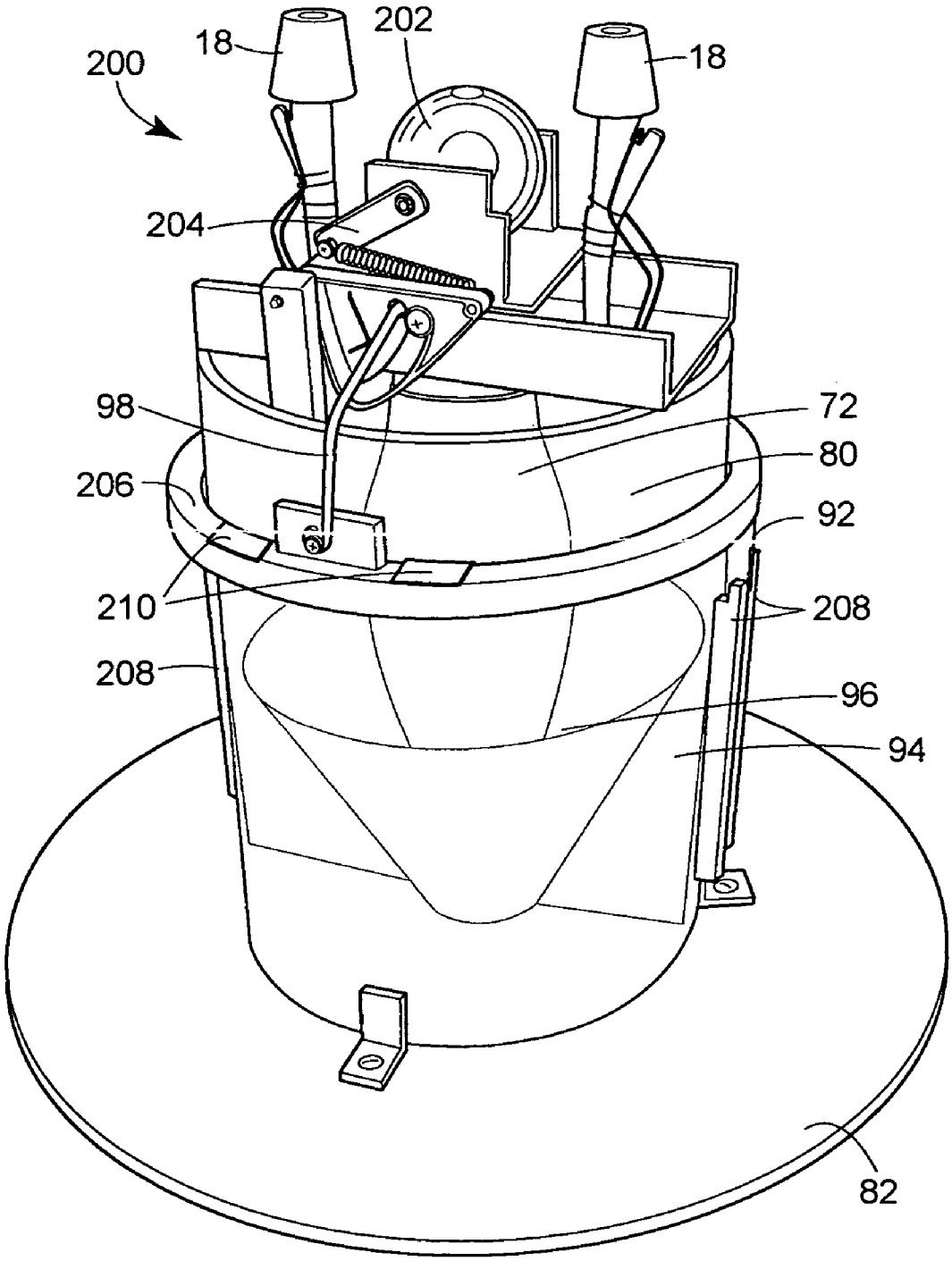
FIG. 8 is a perspective view of the inner mechanism of the sprinkler toy of FIG. 6 in a second geyser discharging position.

FIGS. 6-8 illustrate an alternative embodiment of a sprinkler toy 200 according to the present invention wherein similar components are identified using the same reference numerals. The housing 12 includes moving components 14 in the form of rotatably mounted orbs having indicia in the form of eyeballs and eyelids. Moving components 14 are normally disposed in a position with the eyes exposed and the eyelids open. In the interior mechanism, misting nozzles 18 may be disposed on opposite sides of a ball valve 202 having an actuation mechanism 204 that may be similar to the actuation mechanisms previously described herein. In this embodiment, the stabilizer ring 84 may be replaced with a ring 206 slidable on the exterior surface of the support cylinder 80 and connected to the upper edges of the arms 92 of the funnel bracket 90. The external surface of the support cylinder 80 may have pairs of shoulders 208 disposed on opposite sides and extending outwardly to define channels in which the arms 92 of the funnel bracket 90 may be slidable disposed. The link 98 may be connected between the actuation mechanism 204 and an upper surface of the ring 206 such that downward movement of the ring 206 as the expanding bladder 72 forces the funnel 96 downwardly may cause actuation of the actuation mechanism 204. Additionally, the ring 206 may include a pair of outwardly extending tabs 210 that may be configured to engage the moving components 14 of the outer housing 12 to cause the moving components 14 to move from what appears to be an eyes open position to an eyes closed position as the ring 206 moves downwardly.

Figure 9:
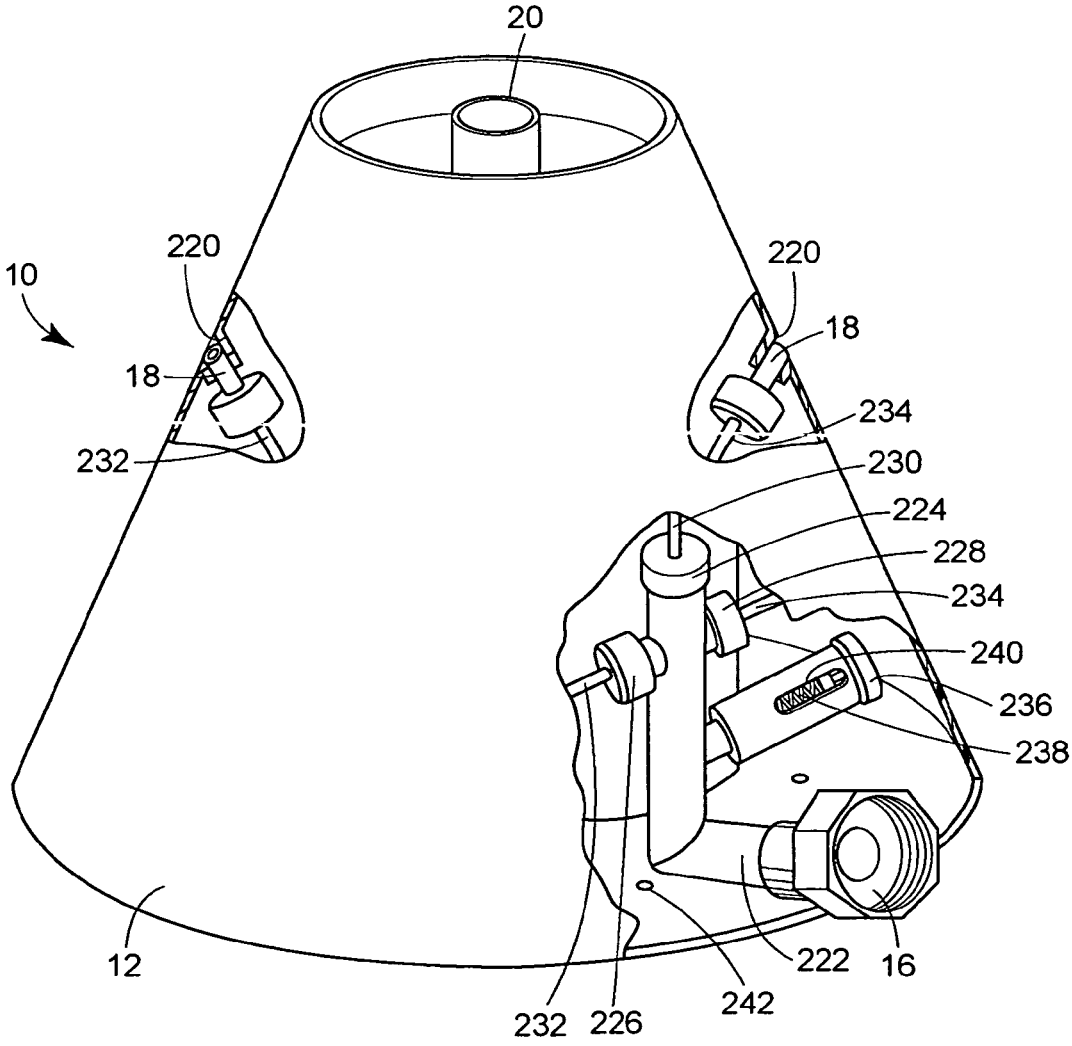
FIG. 9 is a top front perspective view of an alternative embodiment of a sprinkler toy with a geyser-like burst of water with portions of the housing removed.

In an alternate embodiment shown in FIG. 9, the misting nozzles 18 may be disposed in recesses 220 in the side of the housing 12 to provide a constant mist directed upwardly and outwardly from the sprinkler toy 10 at the same time that the sprinkler toy 10 is periodically discharging the geyser-like bursts of water through the large nozzle 20. The hose coupling 16 may pass through the wall of the housing 12 and may be coupled in fluid communication with an inlet pipe 222 disposed on the inside of the housing 12. The inlet pipe 222 may include a plurality of outlets 224, 226, 228 in fluid communication with corresponding tubes 230, 232, 234, respectively. The tube 230 may be connected at the opposite end to the ball valve 32 and bladder 72 to supply the pressurized water from the source connected to the hose coupling 16 to the bladder 72. The tubes 232, 234 may be connected at the opposite ends to the corresponding misting nozzles 18 to provide a constant supply of pressurized water for a constant outward misting spray.

The sprinkler toy 10 may further include a safety release valve 236 connected to the inlet pipe 222 and in fluid communication with the pressurized water source. The safety release valve 236 may include a spring 238 biasing the valve 236 to the closed position and retaining the valve 236 in the closed position until sufficient pressure builds up in the inlet pipe 222 and tubes 230, 232, 234 to force the valve 236 open against the force of the spring 238. For example, in the event the actuation mechanism 140 fails to open the ball valve 32, the safety release valve 236 and spring 238 may be configured to allow the release valve 236 to open after sufficient pressure exists to expand the bladder 72 and open the valve 32 via the actuation mechanism 140, but before sufficient pressure builds up that may cause the bladder 72 and/or the tubes 230, 232, 234 to rupture. Once the release valve 236 opens, the water may be free to flow out of the valve 236 through an opening 240 and out of the sprinkler toy 10 through holes 242 in the base 82. The safety release valve 236 may further include an adjustment mechanism for varying the compression of the spring 238 to obtain a desired release pressure for opening of the valve 236.

Figure 10:
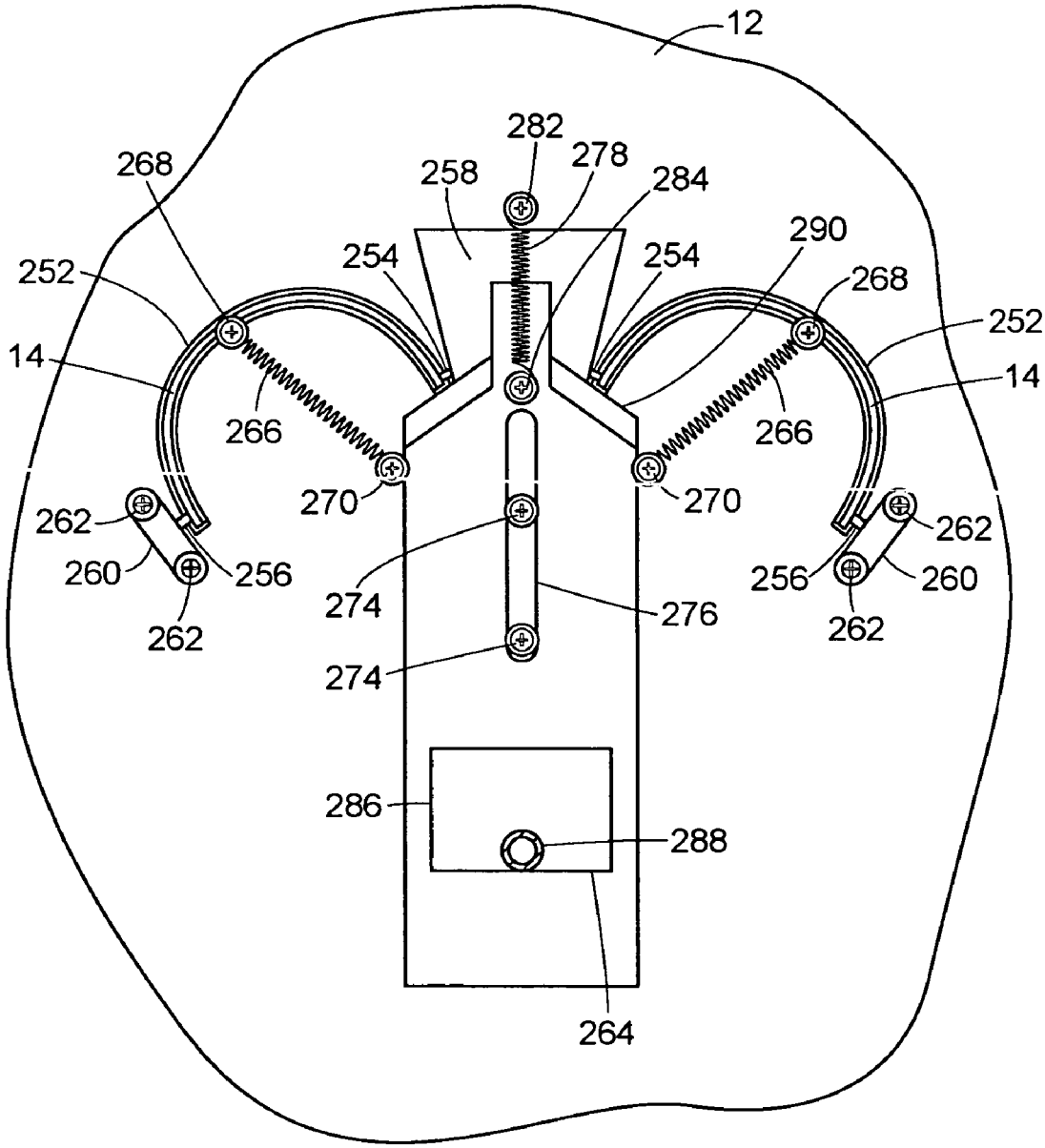
FIG. 10 is a plan view of an embodiment of an actuation mechanism for moving the moving components of the sprinkler toys of FIGS. 1 and 9 in a normal position.
Figure 11:
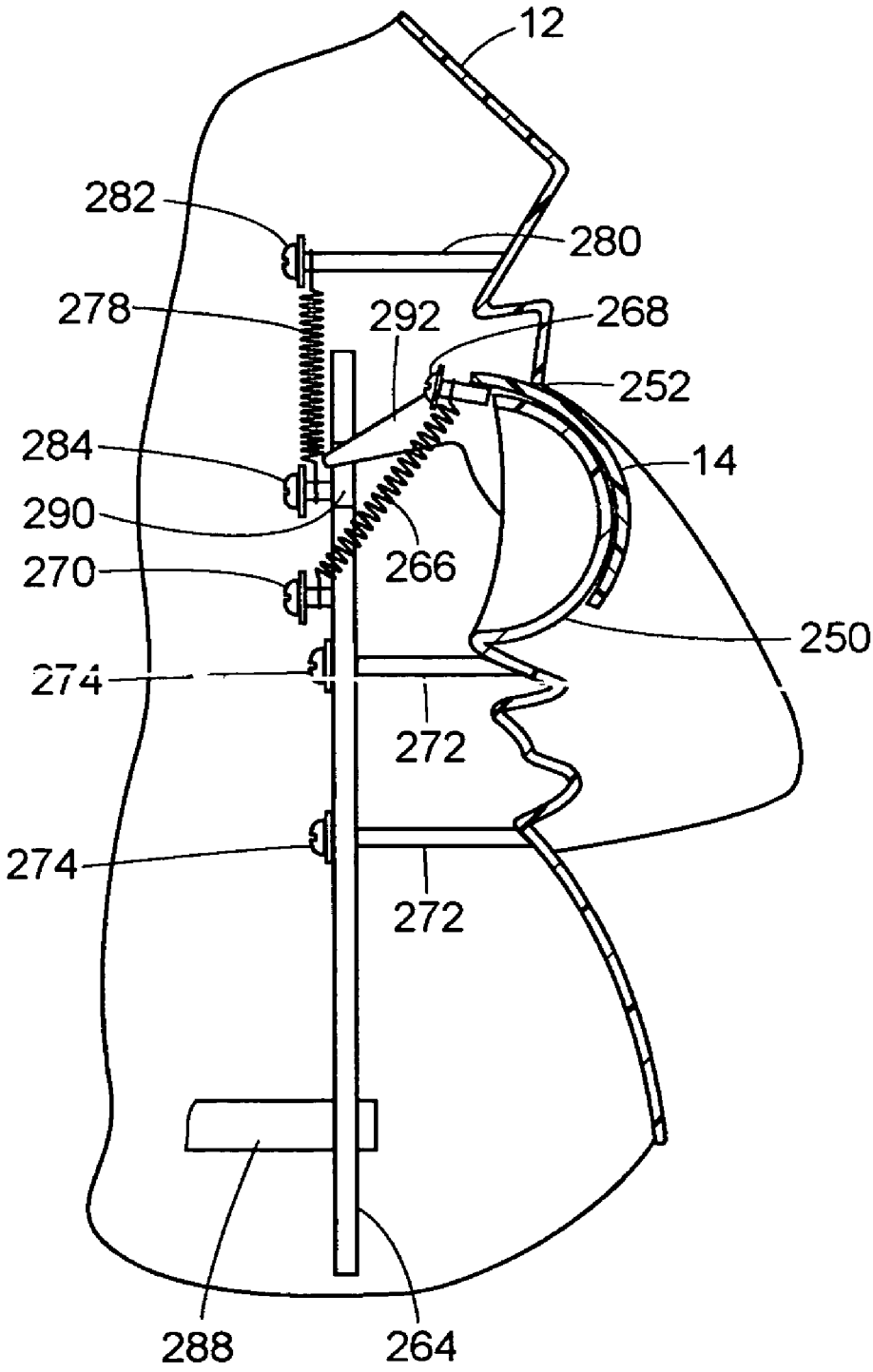
FIG. 11 is a side partial sectional view of the actuation mechanism of FIG. 10 and the housing of the sprinkler toy.
Figure 12:
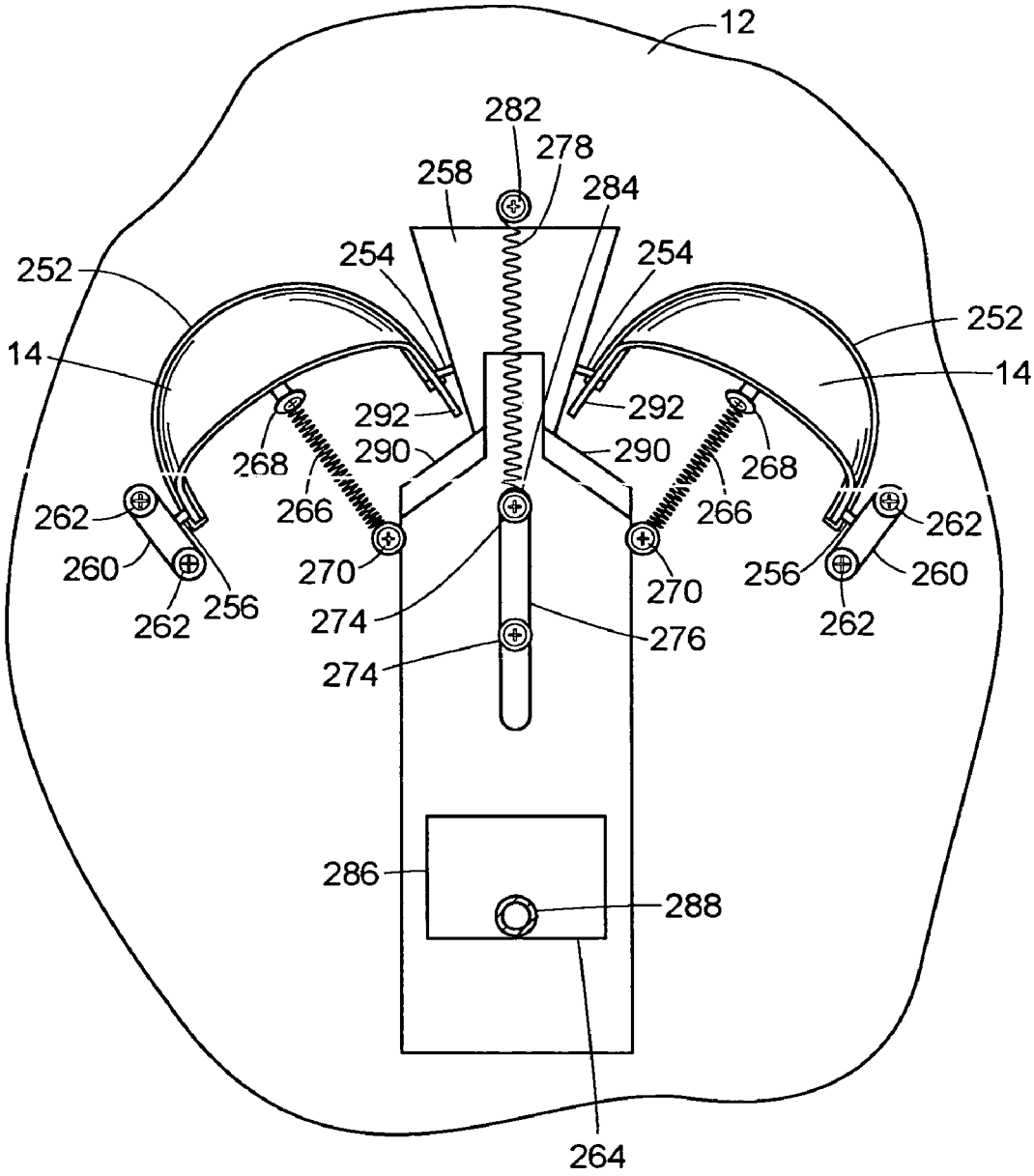
FIG. 12 is a plan view of the actuation mechanism of FIG. 10 in a second position.
Figure 13:
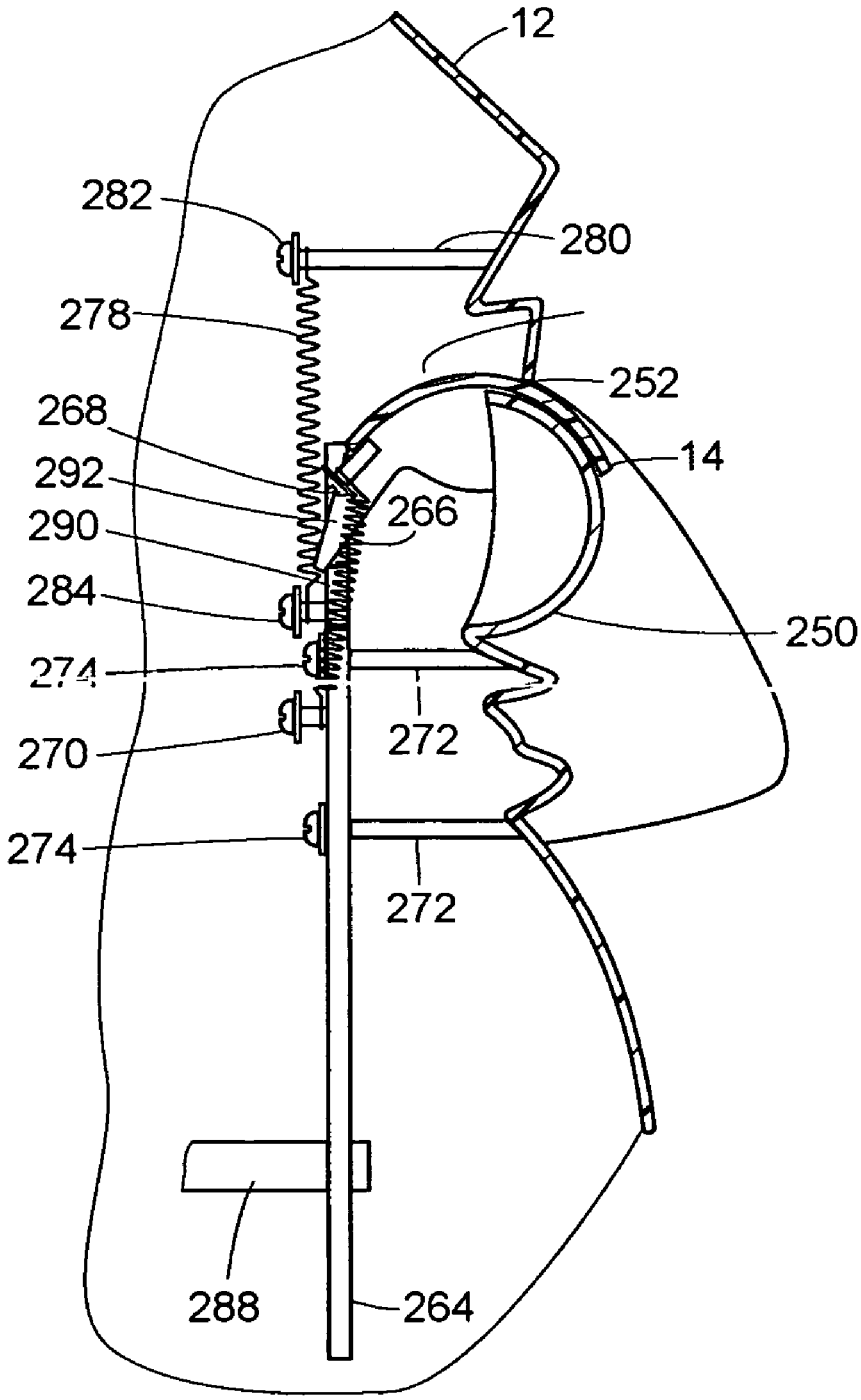
FIG. 13 is a side partial sectional view of the actuation mechanism of FIG. 12 and the housing of the sprinkler toy

FIGS. 10-13 illustrate an embodiment of a mechanism for moving the moving components 14 of the housing 12 as the actuation mechanism 140 moves to alternately open and close the ball valve 32. In the illustrated embodiment, the exterior of the housing 12 may be configured, for example, to resemble a face carved in a mountain side. The moving components 14 may be semi-circular in shape so as to simulate eyelids covering eyes 250 on the face when the ball valve 32 is in the closed position as shown in FIGS. 10 and 11. The eyelids 14 may be disposed within semi-circular openings 252 through the housing 12 at the eyes 250, and may be pivotally coupled to the housing 12 by outwardly extending shafts 254, 256. The shafts 254 may be received by and retained by a central shaft housing 258, while the shafts 256 may be retained by corresponding clamps 260 demountably attached to the housing 12 by screws 262. The eyelids 14 may be coupled to a slide member 264 by springs 266 connected to the eyelids 14 by screws 268 and to the slide member 264 by screws 270. The slide member 264 may be slidably connected to support posts 272 of the housing 12 by screws 274 disposed and slidable within a slot 276 through the slide member 264.

In order to bias the slide member 264 toward the normal upward position, a return spring 278 may be connected between a support post 280 of the housing 12 by a screw 282, and the slide member 264 by a screw 284. The force of the return spring 278 urges the slide member 264 upward with the screws 274 sliding within the slot 276 to move the slide member 264 in an upward linear path. The slide member 264 may further include an opening 286 through which a drive shaft 288 may be disposed when the housing 12 is assembled onto the sprinkler toy 10. The drive shaft 288 may extend outwardly from a moving component of the actuation mechanism 140 such as, for example, an arm 92 of the funnel bracket 90.

Before pressurized water is supplied to the sprinkler toy 10, or just after the sprinkler toy 10 discharges a burst of water and the actuation mechanism 140 returns the valve 32 to the closed position, the return spring 278 biases the slide member 264 to the upward normal position shown in FIGS. 10 and 11. In this position, the eyelids 14 may be disposed over the eyes 250 of the face on the housing 12. As the pressurized water accumulates in the bladder 72, the bladder 72 expands, engages the funnel 96, and forces the funnel bracket 90 downwardly. As the funnel bracket 90 moves downwardly, the drive shaft 288 engages the inner edge of the opening 286 of the slide member 264, thereby also forcing the slide member 264 downward against the urging of the return spring 278. The downward movement of the slide member 264 causes the springs 266 to pull downwardly on the eyelids 14 and rotate the eyelids 14 in the counterclockwise direction in FIGS. 11 and 13. The rotation of the eyelids 14 gives the appearance that the eyes 250 of the face on the housing 12 are opening.

When the actuation mechanism 140 snaps open the ball valve 32, the force of the walls of the bladder 72 forces the water through the ball valve 32, and the bladder 72 contracts. As the bladder 72 contracts and, consequently, decreases the force on the funnel 96, the spring 70 of the actuation mechanism 140 and any other return mechanism return the actuation mechanism 140 and funnel bracket 90 to the normal position with the ball valve 32 closed. As the funnel bracket 90 and drive shaft 288 move upwardly, the return spring 278 may pull the slide member 264 upwardly to the normal position. The slide member 264 may include contoured surfaces defining shoulders 290 that may engage fingers 292 of the eyelids 14 to cause the eyelids 14 to rotate in the clockwise direction and give the appearance that the eyelids 14 are closing over the eyes 250.

Those skilled in the art will understand that additional embodiments of the sprinkler toy in addition to those illustrated herein are possible and contemplated by the inventors. For example, alternate embodiments of reservoirs for storing the pressurized liquid in addition to the bladder 72 are contemplated such that the reservoirs may increase in volume as additional liquid is provided by the pressurized liquid source, and may be operatively coupled to the valve 32 in order to cause the valve 32 to move from the closed position to the open position as the volume of the reservoir increases. In one embodiment, for example, the reservoir may be a cylinder having a piston head biased by a spring to minimum volume position within the cylinder when no liquid is present. As pressurized liquid is pumped into the cylinder, the piston head may move against the force of the spring to increase the volume in the cylinder while the spring force increases the pressure in the cylinder. At the same time, the spring or piston head may be operatively coupled to the valve 32 to cause the valve 32 to open as the piston head moves to increase the volume in the cylinder.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A sprinkler toy for producing a geyser-like burst of liquid supplied by a source of pressurized liquid, comprising:

a reservoir in fluid communication with the pressurized liquid source, wherein the volume of the reservoir increases as the liquid is supplied to the reservoir by the pressurized liquid source; and a valve in fluid communication with the reservoir, wherein the valve is moveable between a closed position and an open position;

a link operatively coupled to the valve such that movement of the link causes the valve to move between the open and closed positions, and with the link operatively coupled to the reservoir with the entire link disposed external to the reservoir, wherein the movement of the reservoir during the increase of the volume of the reservoir from a first volume to a second volume causes the link to move the valve from the closed position to the open position, and wherein the pressure within the reservoir when the valve moves to the open position causes a geyser-like burst of liquid stored in the reservoir to discharge through the valve.

2. A sprinkler toy in accordance with claim 1, wherein the volume of the reservoir decreases from the second volume to the first volume when the geyser-like burst of liquid discharges through the valve, and wherein the valve moves from the open position to the closed position in response to the volume of the reservoir decreasing from the second volume to the first volume.

3. A sprinkler toy in accordance with claim 1, wherein the reservoir comprises an elastomeric bladder.

4. A sprinkler toy in accordance with claim 1, comprising at least one nozzle in fluid communication with the source of pressurized liquid, wherein the nozzle constantly discharges liquid while pressurized liquid is provided by the source.

5. A sprinkler toy in accordance with claim 1, comprising a housing enclosing the reservoir and the valve, the housing including at least one moving component operatively coupled to the reservoir, where the moving component moves from a first position to a second position as the volume of the reservoir increases from the first volume to the second volume.

6. The sprinkler toy of claim 1, wherein the valve is disposed external to the reservoir.

7. A sprinkler toy for producing a geyser-like burst of liquid supplied by a source of pressurized liquid, comprising:

a reservoir in fluid communication with the pressurized liquid source, wherein the volume of the reservoir increases as the liquid is supplied to the reservoir by the pressurized liquid source;

a valve in fluid communication with the reservoir and operatively coupled to the reservoir, wherein the valve is a ball valve that rotates between a closed position and an open position with the rotation of the ball valve opening and closing the valve, wherein the increase of the volume of the reservoir from a first volume to a second volume causes the valve to move from the closed position to the open position, wherein the pressure within the reservoir when the valve moves to the open position causes a geyser-like burst of liquid stored in the reservoir to discharge through the valve; and an actuation mechanism operatively coupling the reservoir and the valve, wherein the reservoir engages the actuation mechanism as the reservoir expands from the first volume to the second volume, and wherein the actuation mechanism moves the valve from the closed position to the open position in response to the engagement by the reservoir.

8. A sprinkler toy for producing a geyser-like burst of liquid supplied by a source of pressurized liquid, comprising:

a reservoir in fluid communication with the pressurized liquid source, wherein the volume of the reservoir increases as the liquid is supplied to the reservoir by the pressurized liquid source;

a valve in fluid communication with the reservoir and operatively coupled to the reservoir, wherein the valve is moveable between a closed position and an open position, wherein the movement of the reservoir during the increase of the volume of the reservoir from a first volume to a second volume causes the valve to move from the closed position to the open position, and wherein the pressure within the reservoir when the valve moves to the open position causes a geyser-like burst of liquid stored in the reservoir to discharge through the valve; and an actuation mechanism operatively coupling the reservoir to the valve with the entire actuation mechanism disposed external to the reservoir, wherein the reservoir engages the actuation mechanism as the reservoir expands from the first volume to the second volume, and wherein the actuation mechanism moves the valve from the closed position to the open position in response to the engagement by the reservoir.

9. A sprinkler toy in accordance with claim 8, wherein the actuation mechanism comprises a quick-release trip assembly that rapidly moves the valve from the closed position to the open position when the reservoir expands to the second volume.

10. A sprinkler toy in accordance with claim 8, wherein the actuation mechanism is configured to move the valve from the open position to the closed position in response to the reservoir contracting from the second volume to the first volume.

11. A sprinkler toy in accordance with claim 8, comprising a housing enclosing the reservoir, the valve and the actuation mechanism, the housing including at least one moving component operatively coupled to the actuation mechanism, where the moving component moves from a first position to a second position as the actuation mechanism moves in response to the volume of the reservoir increasing from the first volume to the second volume.

12. The sprinkler toy of claim 8, wherein the valve is disposed external to the reservoir.

13. A sprinkler toy for producing a geyser-like burst of liquid supplied by a source of pressurized liquid, comprising:

an elastomeric bladder in fluid communication with the pressurized liquid source, wherein the volume of the bladder increases as the liquid is supplied to the bladder by the pressurized liquid source;

a valve in fluid communication with the bladder, wherein the valve is moveable between a closed position and an open position; and an actuation mechanism operatively coupling the bladder to the valve with the entire actuation mechanism disposed external to the bladder, wherein the bladder engages the actuation mechanism as the bladder expands from a first volume to a second volume, wherein the actuation mechanism moves the valve from the closed position to the open position in response to the engagement by the bladder as the bladder expands from the first volume to the second volume, and wherein the pressure within the bladder when the valve moves to the open position causes a geyser-like burst of liquid stored in the bladder to discharge through the valve.

14. A sprinkler toy in accordance with claim 13, wherein the volume of the bladder decreases from the second volume to the first volume when the geyser-like burst of liquid discharges through the valve, and wherein the valve moves from the open position to the closed position in response to the volume of the bladder decreasing from the second volume to the first volume.

15. A sprinkler toy in accordance with claim 13, wherein the valve is a ball valve that rotates between the open position and the closed position with the rotation of the ball valve opening and closing the valve.

16. A sprinkler toy in accordance with claim 13, wherein the actuation mechanism comprises a quick-release trip assembly that rapidly moves the valve from the closed position to the open position when the bladder expands to the second volume.

17. A sprinkler toy in accordance with claim 13, wherein the actuation mechanism is configured to move the valve from the open position to the closed position in response to the bladder contracting from the second volume to the first volume.

18. A sprinkler toy in accordance with claim 13, comprising a housing enclosing the bladder, the valve and the actuation mechanism, the housing including at least one moving component operatively coupled to the actuation mechanism, where the moving component moves from a first position to a second position as the actuation mechanism moves in response to the volume of the bladder increasing from the first volume to the second volume.

19. A sprinkler toy in accordance with claim 13, comprising at least one nozzle in fluid communication with the source of pressurized liquid, wherein the nozzle constantly discharges liquid while pressurized liquid is provided by the source.

20. The sprinkler toy of claim 13, wherein the valve is disposed external to the reservoir.

21. A method for producing a geyser-like burst of liquid from a sprinkler toy, comprising:

operatively coupling a valve of the sprinkler toy to a reservoir of the sprinkler toy such that the valve and the reservoir are in fluid communication with each other, wherein a link is operatively coupled to the valve and to the reservoir such that movement of the link causes the valve to move between a closed position and an open position, and wherein the entire link is disposed external to the reservoir;

connecting a pressurized liquid source to the reservoir such that the source and reservoir are in fluid communication, wherein the volume of the reservoir increases as the liquid is supplied to the reservoir by the pressurized liquid source; and providing pressurized liquid to the reservoir of the sprinkler toy to increase the volume of the reservoir from a first volume to a second volume, wherein movement of the reservoir during the increase from the first volume to the second volume causes the link to move the valve from the closed position to the open position, with the pressure within the reservoir when the valve moves to the open position causing a geyser-like burst of liquid stored in the reservoir to discharge through the valve.

22. A method in accordance with claim 21, wherein the volume of the reservoir decreases from the second volume to the first volume when the geyser-like burst of liquid discharges through the valve, the method comprising operatively connecting the link to the reservoir and to the valve such that the valve moves from the open position to the closed position in response to the volume of the reservoir decreasing from the second volume to the first volume.

23. A method in accordance with claim 21, wherein the reservoir is an elastomeric bladder.

24. A method in accordance with claim 21, comprising operatively connecting at least one nozzle in fluid communication with the source of pressurized liquid such that the nozzle constantly discharges liquid while pressurized liquid is provided by the source.

25. A method in accordance with claim 21, comprising:

enclosing the reservoir and the valve in a housing including at least one moving component operatively coupled to the reservoir; and operatively connecting the moving components to the reservoir such that the moving component moves from a first position to a second position as the volume of the reservoir increases from the first volume to the second volume.

26. The method of claim 21, wherein the valve is disposed external to the reservoir.

27. A method for producing a geyser-like burst of liquid from a sprinkler toy, comprising:

operatively coupling a valve of the sprinkler toy to a reservoir of the sprinkler toy such that the valve and the reservoir are in fluid communication with each other, wherein the valve is a ball valve that rotates between the open position and the closed position with the rotation of the ball valve opening and closing the valve;

operatively coupling an actuation mechanism to the reservoir and to the valve such that the reservoir engages the actuation mechanism as the reservoir expands from a first volume to a second volume, and such that the actuation mechanism moves the valve from the closed position to the open position in response to the engagement by the reservoir;

connecting a pressurized liquid source to the reservoir such that the source and reservoir are in fluid communication, wherein the volume of the reservoir increases as the liquid is supplied to the reservoir by the pressurized liquid source; and providing pressurized liquid to the reservoir of the sprinkler toy to increase the volume of the reservoir from a first volume to a second volume to cause the valve to move from the closed position to the open position, with the pressure within the reservoir when the valve moves to the open position causing a geyser-like burst of liquid stored in the reservoir to discharge through the valve.

28. A method for producing a geyser-like burst of liquid from a sprinkler toy, comprising:

operatively coupling a valve of the sprinkler toy to a reservoir of the sprinkler toy such that the valve and the reservoir are in fluid communication with each other, wherein the valve is moveable between a closed position and an open position;

operatively coupling an actuation mechanism to the reservoir and to the valve such that movement of the reservoir during expansion of the reservoir from a first volume to a second volume causes the reservoir to engage the actuation mechanism, such that the actuation mechanism moves the valve from the closed position to the open position in response to the engagement by the reservoir, wherein the entire actuation mechanism is disposed external to the reservoir;

connecting a pressurized liquid source to the reservoir such that the source and reservoir are in fluid communication, wherein the volume of the reservoir increases as the liquid is supplied to the reservoir by the pressurized liquid source; and providing pressurized liquid to the reservoir of the sprinkler toy to increase the volume of the reservoir from the first volume to the second volume to cause the valve to move from the closed position to the open position, with the pressure within the reservoir when the valve moves to the open position causing a geyser-like burst of liquid stored in the reservoir to discharge through the valve.

29. A method in accordance with claim 28, wherein the actuation mechanism comprises a quick-release trip assembly that rapidly moves the valve from the closed position to the open position when the reservoir expands to the second volume.

30. A method in accordance with claim 28, comprising configuring the actuation mechanism to move the valve from the open position to the closed position in response to the reservoir contracting from the second volume to the first volume.

31. A method in accordance with claim 28, comprising:

enclosing the reservoir, the valve and the actuation mechanism in a housing including at least one moving component operatively coupled to the actuation mechanism; and operatively connecting the moving components to the actuation mechanism such that the moving component moves from a first position to a second position as the actuation mechanism moves in response to the volume of the reservoir increasing from the first volume to the second volume.

32. The method of claim 28, wherein the valve is disposed external to the reservoir.

* * * * *